US007176395B2

(12) United States Patent
Holland

(10) Patent No.: US 7,176,395 B2
(45) **Date of Patent: *Feb. 13, 2007**

(54) MULTI-SWITCH THROW LINKAGE

(75) Inventor: Michael Jerome Holland, Hillard, OH (US)

(73) Assignee: Siemens Energy & Automation, Inc., Alpharetta, GA (US)

( * ) Notice: Subject to any disclaimer, the term of this patent is extended or adjusted under 35 U.S.C. 154(b) by 368 days.

This patent is subject to a terminal disclaimer.

(21) Appl. No.: 10/975,750

(22) Filed: Oct. 28, 2004

(65) Prior Publication Data

US 2005/0205398 A1 Sep. 22, 2005

Related U.S. Application Data

(63) Continuation-in-part of application No. 10/798,673, filed on Mar. 11, 2004, now Pat. No. 6,815,623.

(51) Int. Cl.
*H01H 9/26* (2006.01)

(52) U.S. Cl. ..... 200/50.32; 200/50.33

(58) Field of Classification Search ..... 200/50.32–50.4
See application file for complete search history.

(56) References Cited

U.S. PATENT DOCUMENTS 410,313 A 9/1889 Coffin
2,368,083 A 1/1945 Adam
2,531,157 A 11/1950 Pifke
3,303,300 A 2/1967 Turnbull
3,401,364 A 9/1968 Whiting
4,034,170 A 7/1977 Raabe et al.
4,598,264 A 7/1986 Suter
4,724,512 A 2/1988 Bischof et al.
4,924,041 A 5/1990 Yee
5,725,085 A 3/1998 Seymour et al.
5,886,311 A 3/1999 Morel et al.
6,043,439 A 3/2000 Crooks et al.
6,194,675 B1 2/2001 Greer
6,320,143 B1 11/2001 Greer
6,815,623 B1 * 11/2004 Holland ..... 200/50.32
6,872,900 B1 * 3/2005 Lament et al. ..... 200/50.32

* cited by examiner

*Primary Examiner*—Michael A. Friedhofer
(74) *Attorney, Agent, or Firm*—Foley & Lardner LLP

(57) ABSTRACT

A multi-switch linkage for coupling two switch apparatuses together in an enclosure. Each switch apparatus is coupled to the switch mechanism having a switch mechanism lever arm. When the lever arm is moved it translates a force to the actuator plate which closes both switch mechanisms or opens both switch mechanisms.

13 Claims, 2 Drawing Sheets

MULTI-SWITCH THROW LINKAGE

CROSS-REFERENCE

This application is a Continuation-In-Part of U.S. application Ser. No. 10/798,673, filed Mar. 11, 2004 now U.S. Pat. No. 6,815,623, incorporated herein by reference in its entirety.

FIELD

The present invention is directed to linkages for controlling switches and more particularly to a linkage for use as a switch for controlling two switches mounted in the same enclosure so that both switches can be simultaneously turned on or off at any given time.

BACKGROUND

Switching apparatus can connect two load devices to a source of electric power or to connect a single load device to two separate sources of electric power. For example, two lines coming into a switch tied to two loads coming out of the switch. Configurations to produce a 4-pole or 6-pole switch can be arranged by ganging two switches together for simultaneous operation. The two switch mechanisms are tied together with a linkage. The linkage allows both switches to be turned on or off at a time. Prior linkages typically are assembled using multiple slots in a plate which is secured to a framework by multiple fasteners or rivets which slide in the plurality of slots.

There is a need for a multi-switch linkage that requires fewer parts for assembly thereby reducing costs and complexity.

SUMMARY OF THE INVENTION

There is provided a multi-switch linkage for coupling two switch apparatuses together in an enclosure. Each switch apparatus is coupled to the switch mechanism having a switch mechanism lever arm. The multi-switch linkage comprises an interlock housing, with the interlock housing defining a pair of actuator plate slots and a first orifice and a second orifice. Each orifice is configured to provide unimpeded passage of each switch mechanism lever arm. An actuator plate is slidingly mounted in the actuator plate slots. The actuator plate is free floating in the interlock housing. The actuator plate defines a first switch slot, a second switch slot, and a driver arm slot. Each switch slot is configured to guide a pin mounted on each switch mechanism lever arm. A lever arm assembly is mounted on a sidewall of the enclosure with the lever arm assembly including a lever arm coupled to a driver arm. The driver arm is configured to engage the driver arm slot and the actuator plate. When the lever arm is moved it translates a force to the actuator plate which closes both switch mechanisms or open both switch mechanisms.

There is also provided an electric double switch comprising an enclosure having at least one sidewall, a bottom wall and a cover. A first switch apparatus, including a first switch mechanism having a lever arm is mounted in the enclosure. A second switch apparatus, including a second switch mechanism having a lever arm, is mounted in the enclosure. A multi-switch linkage is coupled to each of the first and second switch apparatus. The multi-switch linkage comprises an interlock housing, with the interlock housing defining a pair of actuator plate slots and a first orifice and a second orifice. Each orifice is configured to provide unimpeded passage of each switch mechanism lever arm. An actuator plate is slidingly mounted in the actuator plate slots. The actuator plate defines a first switch slot, a second switch slot, and a driver arm slot. Each switch slot is configured to guide a pin mounted on each switch mechanism lever arm. A lever arm assembly is mounted on the sidewall of the enclosure. The lever arm assembly includes a lever arm coupled to a driver arm, with the driver arm configured to engage the driver arm slot in the actuator plate. Upon movement of the lever arm, the lever arm translates a force to the actuator plate which closes both switch apparatuses or opens both switch apparatuses.

Also provided is a method for interlocking two switch apparatus mounted in an enclosure. Each switch apparatus has a switch mechanism including a switch mechanism lever arm and the enclosure has a cover and a sidewall. The method comprises the steps of providing an interlock housing. The interlock housing defining a pair of actuator plate slots and a first orifice and a second orifice, with each orifice configured to provide unimpeded passage of each switch mechanism lever arm. Mounting the interlock housing in the enclosure adjacent to the switch mechanisms. Providing an actuator plate, with the actuator plate defining a first switch slot, a second switch slot and a driver arm slot. Each switch slot is configured to guide a pin mounted on each switch mechanism lever arm. Inserting the actuator plate in each actuator plate slot for free sliding movement. Aligning the pin on each switch mechanism arm in one of the first and second switch slots in the actuator plate. Mounting a lever arm assembly on the sidewall of the enclosure, with the lever arm assembly including a lever arm coupled to a driver arm. Aligning the driver arm to engage the driver arm slot in the actuator plate. Moving the lever arm to translate a force to the actuator plate wherein both switch apparatuses are closed or both switch apparatuses are maintained in an open position. An alternative embodiment for the method includes the step of providing an interlock release mechanism coupled to the cover and the interlock housing, wherein the cover can be opened if the switch apparatuses are closed.

DETAILED DESCRIPTION OF EXEMPLARY EMBODIMENTS

Figure 1:
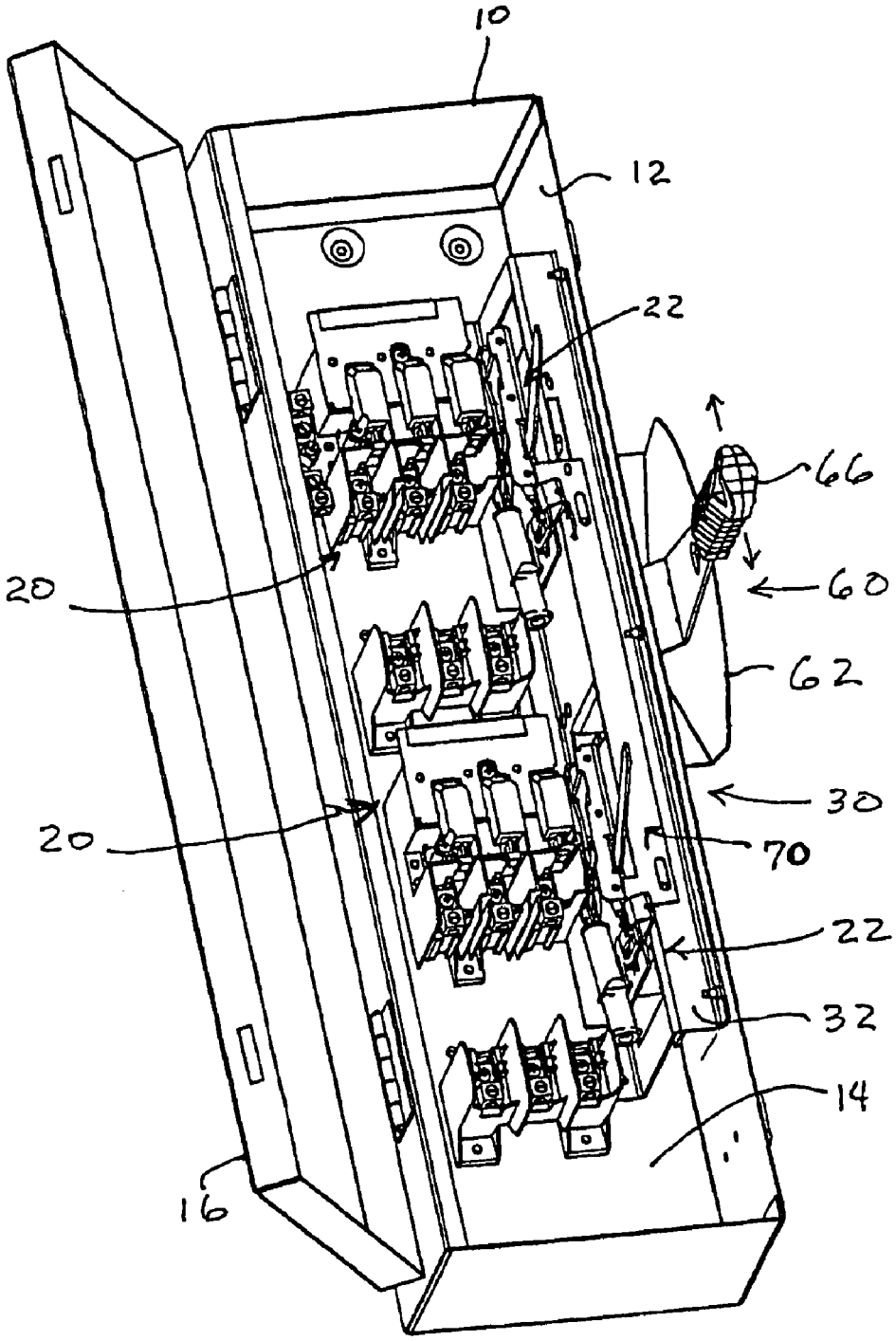
FIG. 1 is a perspective view of an exemplary embodiment of an electrical enclosure housing two switch apparatus coupled to an exemplary embodiment of a multi-switch linkage.

Referring to the figures, FIG. 1 illustrates an exemplary embodiment of a multi-switch linkage 30 mounted in an enclosure 10 and coupled to a pair of switch mechanisms 22. Each switch mechanism 22 is coupled to a switch apparatus 20. The enclosure 10 typically includes sidewalls 12, a bottom wall 14 and a cover 16. The switch apparatus 20, typically are configured for multiple phase connections and can be rated at 30 to 200 amps. For such ratings, the enclosures are typically North American Electrical Manufacturers Association (NEMA) Type 1, 3R, 4X and 12. Switch enclosures may also be configured to accommodate switch apparatus 20 that are rated in the range of 400 to 1200 amps. In such cases, the enclosures typically are NEMA Type 1 and 3R. It is contemplated, that other current rating and enclosure configurations can be suitable for the multi-switch linkage disclosed herein.

A multi-switch is actually two switch apparatus 20 combined in a single enclosure 10. The switch mechanisms 22 are coupled together with a multi-switch linkage 30. The multi-switch linkage 30 allows both switches to be turned "ON" at any given time, or "OFF" at any given time.

A typical operating sequence for a multi-switch throw mechanism provides that the lever arm 66 of a lever arm assembly 60 is positioned in an "OFF" position which typically is at one end of the lever arm 66 stroke. In such position, both switch apparatus 20 are "OFF". If an operator, for example, moves the lever arm 66 in the opposite direction, to the end of the stroke, both switches apparatus move to an "ON" position. The direction of the lever arm 66 motion should be consistent with accepted conventions in the power switch industry and related standards.

Figure 2:
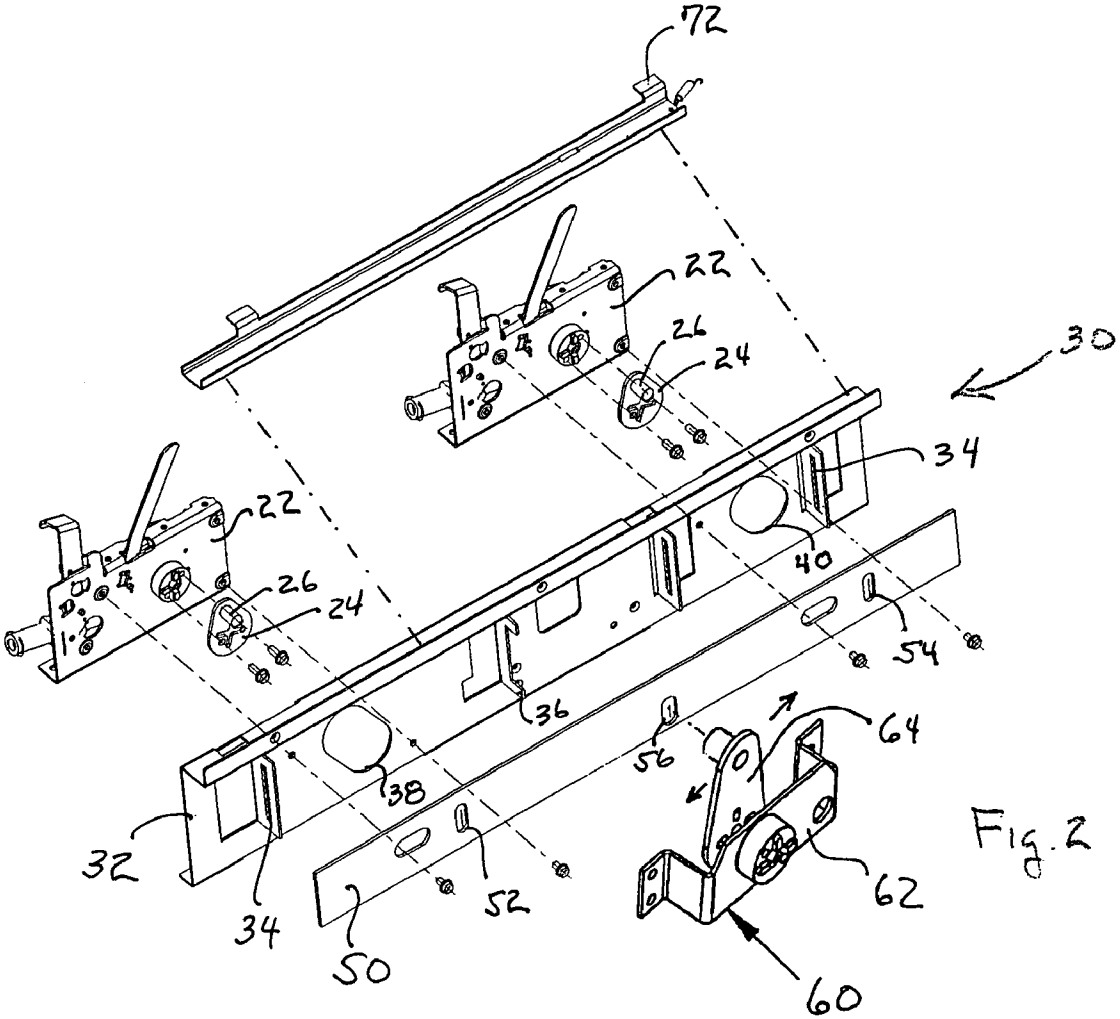
FIG. 2 is an exploded perspective view of an exemplary embodiment of a multi-switch linkage.

Referring to FIG. 2, there is illustrated an exemplary embodiment of a multi-switch linkage 30. An interlock housing 32 is configured to define a pair of actuator plate slots 34 and a first orifice 38 and a second orifice 40. Each orifice 38, 40 is configured to provide unimpeded passage of each switch mechanism lever arm 24. The actuator plate slots 34 are typically stamped from the interlock housing 32 if the actuator plate 50 is metal and are configured in a rectangular shape. The actuator plate slots are aligned with one another on a horizontal axis with one actuator plate slot 34 proximate each end of the interlock housing 32. At approximately the midpoint of the distance between the two actuator plate slots 34, an actuator plate guide 36 may be provided to assist in guiding the actuator plate 50 as will be described below.

A switch mechanism lever arm 24 is coupled to each switch mechanism 22. A typical coupling includes two screws to mount the switch mechanism lever arm 24. Each switch mechanism lever arm includes a switch mechanism lever arm pin 26. The switch mechanism lever arm 24 passes through each orifice 38, 40 formed in the interlock housing 32 and is not fastened to the interlock housing 32.

An actuator plate 50 is slidingly mounted in the actuator plate slots 34. The actuator plate 50 free floats in the interlock housing 32 within the actuator plate slots 34. The intermediate actuator plate guide 36 assists in maintaining the orientation of the actuator plate 50 with respect to the interlock housing 32. The actuator plate 50 defines a first switch slot 52 and a second switch slot 54. Each switch slot 52, 54 is proximate each end of the actuator plate 50 and is aligned with the switch mechanism lever arm pin 26. A typical configuration for each switch slot 52, 54 is an oblong slot. The actuator plate 50 also defines a driver arm slot 56 which is located proximate the midpoint of the actuator plate 50. It should be understood that its location is defined by the relative lateral motion required to actuate the multi-switch linkage 30 to have both switch apparatus 20 open or both switch apparatus 20 closed.

A lever arm assembly 60 is mounted on a sidewall 12 of the enclosure 10. (See FIG. 1.) The lever arm assembly 60 includes a lever arm 66 (also referred to as an operating handle) coupled to a driver arm 64. The driver arm 64 is configured to engage the driver arm slot 56 in the actuator plate 50.

When the lever arm 66 is moved by an operator (as shown by the arrows in FIGS. 1 and 2) a force is applied to the actuator plate 50 by the driver arm 64 which moves the actuator plate 50. As the actuator plate 50 is moved, the switch mechanism lever arm pin 26 follows in the actuator plate slot 52, 54 thereby rotating the switch mechanism lever arm 24 and actuating the switch mechanism 22. Because of the actuator plate slot 34 configuration, both of the switch apparatus 20 will be closed (energized) and both switch apparatus 20 will be maintained in an open position (unenergized) upon movement of the actuator plate 50 to either end of its stroke.

An interlock release mechanism 70 is configured to release the cover 16 interlocks so that the cover 16 can be opened with the switch apparatus 20 in the "ON" position. An interlock release linkage is coupled to the interlock release bar 72 which is operatively aligned with each switch apparatus and engages the cover. 16 interlocks.

As illustrated in FIGS. 1–2, the actuator plate 50 is a single member. The actuator plate 50 can be composed of a material selected from a group including a metal, such as steel, a plastic, a composite material, or any two of such materials. In any event, the material used for the actuator plate 50 should be of a strength and composition that is sufficient and suitable for the mechanical forces exerted upon the actuator plate 50 and the electrical ratings of the switch apparatus 20.

Thus there has been disclosed a multi-switch linkage for coupling two switch apparatus together in an enclosure, with the multi-switch linkage configured to open both switch apparatus and close both switch apparatus with a single lever arm assembly. Other substitutions, modifications, changes and omissions may be made in the design, operating conditions and arrangement of the preferred and other exemplary embodiments without departing from the spirit of the present invention and as defined in the appended claims.

What is claimed is:

1. A multi-switch linkage for coupling two switch apparatus together in an enclosure, with each switch apparatus coupled to a switch mechanism having a switch mechanism lever arm, the multi-switch linkage comprising:

an interlock housing, the interlock housing defining a pair of actuator plate slots and a first orifice and a second orifice, with each orifice configured to provide unimpeded passage of each switch mechanism lever arm;

an actuator plate slidingly mounted in the actuator plate slots, with the actuator plate defining a first switch slot, a second switch slot and a driver arm slot, with each switch slot configured to guide a pin mounted on each switch mechanism lever arm; and a lever arm assembly mounted on a side wall of the enclosure, with the lever arm assembly including a lever arm coupled to a driver arm, with the driver arm configured to engage the driver arm slot in the actuator plate, wherein movement of the lever arm translates a force to the actuator plate which closes both switches apparatus or opens both switch apparatuses.

2. The multi-switch linkage of claim 1, including an interlock release mechanism configured to release a cover of the enclosure if the switch apparatuses are closed.

3. The multi-switch linkage of claim 2, wherein the interlock release mechanism includes an interlock bar coupled to the interlock housing and operatively aligned with each switch apparatus.

4. The multi-switch linkage of claim 1, wherein the actuator plate is a single piece.

5. The multi-switch linkage of claim 1, wherein the actuator plate is composed of a material selected from a group including a metal, a plastic, a composite material, and any two of such materials.

6. An electric double switch comprising:

an enclosure having at least one sidewall, a bottom wall, and a cover;

a first switch apparatus, including a first switch mechanism having a lever arm, mounted in the enclosure;

a second switch apparatus, including a second switch mechanism having a lever arm, mounted in the enclosure; and a multi-switch linkage coupled to each of the first and second switch apparatus, the multi-switch linkage comprising:

an interlock housing, the interlock housing defining a pair of actuator plate slots and a first orifice and a second orifice, with each orifice configured to provide unimpeded passage of each switch mechanism lever arm;

an actuator plate slidingly mounted in the actuator plate slots, with the actuator plate defining a first switch slot, a second switch slot and a driver arm slot, with each switch slot configured to guide a pin mounted on each switch mechanism lever arm; and a lever arm assembly mounted on the side wall of the enclosure, with the lever arm assembly including a lever arm coupled to a driver arm, with the driver arm configured to engage the driver arm slot in the actuator plate, wherein movement of the lever arm translates a force to the actuator plate which closes both switch apparatus or opens both switch apparatuses.

7. The electric double switch of claim 6, including an interlock release mechanism configured to release a cover of the enclosure if the switch apparatuses are closed.

8. The electric double switch of claim 7, wherein the interlock release mechanism includes an interlock bar coupled to the interlock housing and operatively aligned with each switch apparatus.

9. The electric double switch of claim 6, wherein the actuator plate is a single piece.

10. The electric double switch of claim 6, wherein the actuator plate is composed of a material selected from a group including a metal, a plastic, a composite material, and any two of such materials.

11. A method for interlocking two switch apparatus mounted in an enclosure, with each switch apparatus having a switch mechanism including a switch mechanism lever arm and the enclosure having a cover and a sidewall, the method comprising the steps of:

providing an interlock housing, the housing defining a pair of actuator plate slots and a first orifice and a second orifice, with each orifice configured to provide unimpeded passage of each suited mechanism lever arm;

mounting the interlock housing in the enclosure adjacent to the switch mechanism;

providing an actuator plate, with the actuator plate defining a first switch slot, a second switch slot and a driver arm slot, with each switch slot configured to guide a pin mounted on each switch mechanism lever arm;

inserting the actuator plate in each actuator plate slot for free sliding movement;

aligning the pin on each switch mechanism lever arm in one of the first and second switch slots in the actuator plate;

mounting a lever arm assembly on the sidewall of the enclosure, with the lever arm assembly including a lever arm coupled to a driver arm;

aligning the driver arm to engage the driver arm slot in the actuator plate; and moving the lever arm to translate a force to the actuator plate wherein both switch apparatuses are closed or both switch apparatuses are open.

12. The method of claim 11, including the steps of providing an interlock release mechanism coupled to the cover and interlock housing, wherein the cover can be opened if the switch apparatuses are closed.

13. The method of claim 11, wherein the actuator plate is composed of a material selected from a group including a metal, a plastic, a composite material, and any two of such materials.

* * * * *